US006781493B1

(12) United States Patent
Gorginians

(10) Patent No.: US 6,781,493 B1
(45) Date of Patent: Aug. 24, 2004

(54) MAGNET ASSEMBLY

(76) Inventor: Seroosh Gorginians, 1065 Thompson Ave., Glendale, CA (US) 91201

( * ) Notice: Subject to any disclaimer, the term of this patent is extended or adjusted under 35 U.S.C. 154(b) by 151 days.

(21) Appl. No.: 10/251,056

(22) Filed: Sep. 23, 2002

(51) Int. Cl.[7] ..... H01F 7/20
(52) U.S. Cl. ..... 335/293; 294/65.5
(58) Field of Search ..... 335/293, 285, 335/286; 294/65.5

(56) References Cited

U.S. PATENT DOCUMENTS 3,924,115 A * 12/1975 Hampton et al. ..... 362/577
4,128,851 A * 12/1978 Sedley ..... 360/4
5,261,714 A * 11/1993 Slusar et al. ..... 294/65.5
5,348,359 A * 9/1994 Boozer ..... 294/24
5,782,149 A * 7/1998 Jensen ..... 81/125
6,104,162 A * 8/2000 Sainsbury et al. ..... 320/111
6,487,779 B1 * 12/2002 Underthun ..... 30/277.4
6,573,621 B2 * 6/2003 Neumann

FOREIGN PATENT DOCUMENTS

GB 2106326 A * 4/1983 ..... H01F/7/20

* cited by examiner

*Primary Examiner*—Karl D. Easthom
*Assistant Examiner*—Bernard Rojas

(57) ABSTRACT

A magnet assembly for attaching to nails, bolts, metal shavings and other magnetic-conducting objects. The magnet assembly includes an elongate housing having side and end walls, and also having openings in the end walls; and also includes an assembly of producing magnetism including coiled wires being disposed in the elongate housing, and also including a battery being disposed in the elongate housing and being connected to the coiled wires, and further including an on/off switch being movably mounted to the elongate housing and being connected to the battery and to the coiled wires; and further includes at least one magnetizable tool being removably received through one of the openings of the elongate housing for picking up small objects.

4 Claims, 2 Drawing Sheets

MAGNET ASSEMBLY

BACKGROUND OF THE INVENTION

1. Field of the Invention

The present invention relates to magnets and more particularly pertains to a new magnet assembly for attaching to nails, bolts, metal shavings and other magnetic-conducting objects.

2. Description of the Prior Art

The use of magnets is known in the prior art. More specifically, magnets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 555,546; 2,605,658; 5,261,714; 5,945,901; 6,113,169; and 2,471,764.

While these devices fulfill their respective, particular objectives and requirements, the aforementioned patents do not disclose a new magnet assembly. The prior art includes shafts and coiled wires wound about the shafts and being connected to power sources for energizing the coiled wires to effect magnetism.

SUMMARY OF THE INVENTION

The general purpose of the present invention, which will be described subsequently in greater detail, is to provide a new magnet assembly which has many of the advantages of the magnets mentioned heretofore and many novel features that result in a new magnet assembly which is not anticipated, rendered obvious, suggested, or even implied by any of the prior art magnets, either alone or in any combination thereof. The present invention includes an elongate housing having side and end walls, and also having openings in the end walls; and also includes an assembly of producing magnetism including coiled wires being disposed in the elongate housing, and also including a battery being disposed in the elongate housing and being connected to the coiled wires, and further including an on/off switch being movably mounted to the elongate housing and being connected to the battery and to the coiled wires; and further includes at least one magnetizable tool being removably received through one of the openings of the elongate housing for picking up small objects. None of the prior art includes the combination of elements of the present invention.

There has thus been outlined, rather broadly, the more important features of the magnet assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new magnet assembly which has many of the advantages of the magnets mentioned heretofore and many novel features that result in a new magnet assembly which is not anticipated, rendered obvious, suggested, or even implied by any of the prior art magnets, either alone or in any combination thereof.

Still another object of the present invention is to provide a new magnet assembly for attaching to nails, bolts, metal shavings and other magnetic-conducting objects.

Still yet another object of the present invention is to provide a new magnet assembly that is easy and convenient to set up and use.

Even still another object of the present invention is to provide a new magnet assembly that allows for the user to pick up otherwise hard-to-pick-up items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
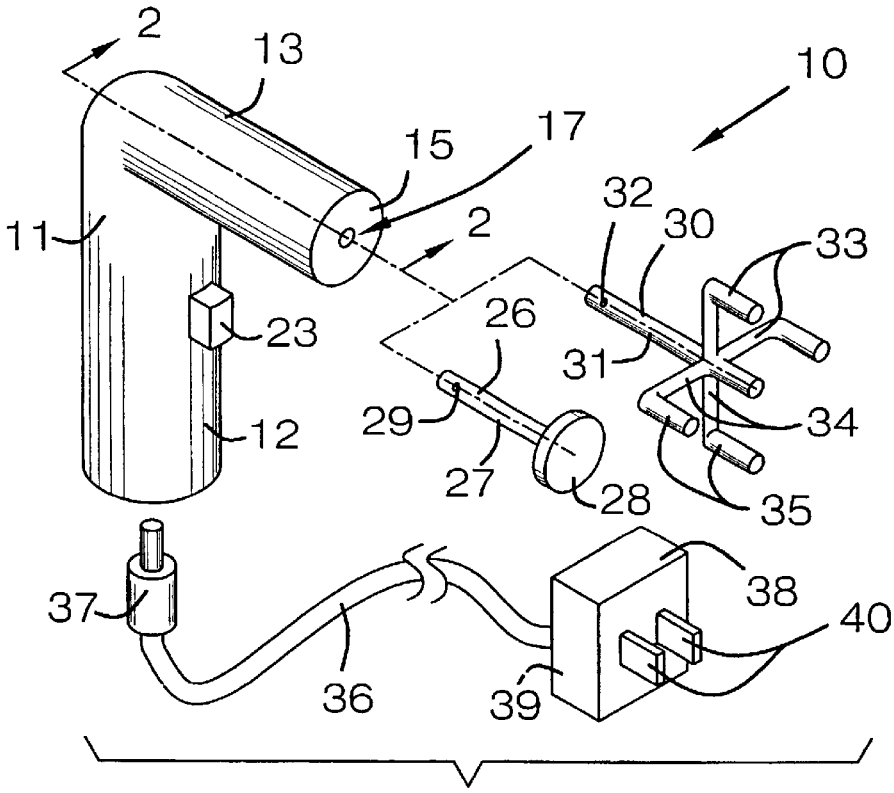
FIG. 1 is a partial exploded perspective view of a new magnet assembly according to the present invention.
Figure 3:
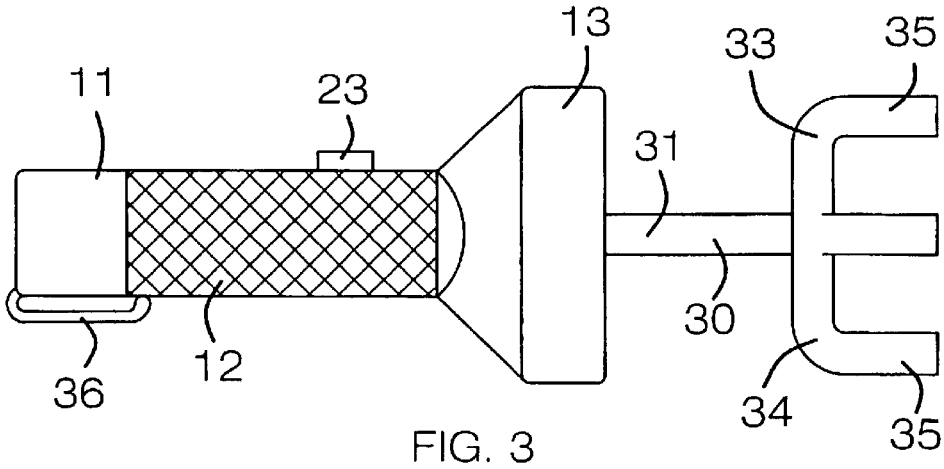
FIG. 3 is a cross-sectional view of a second embodiment of the present invention.
Figure 2:
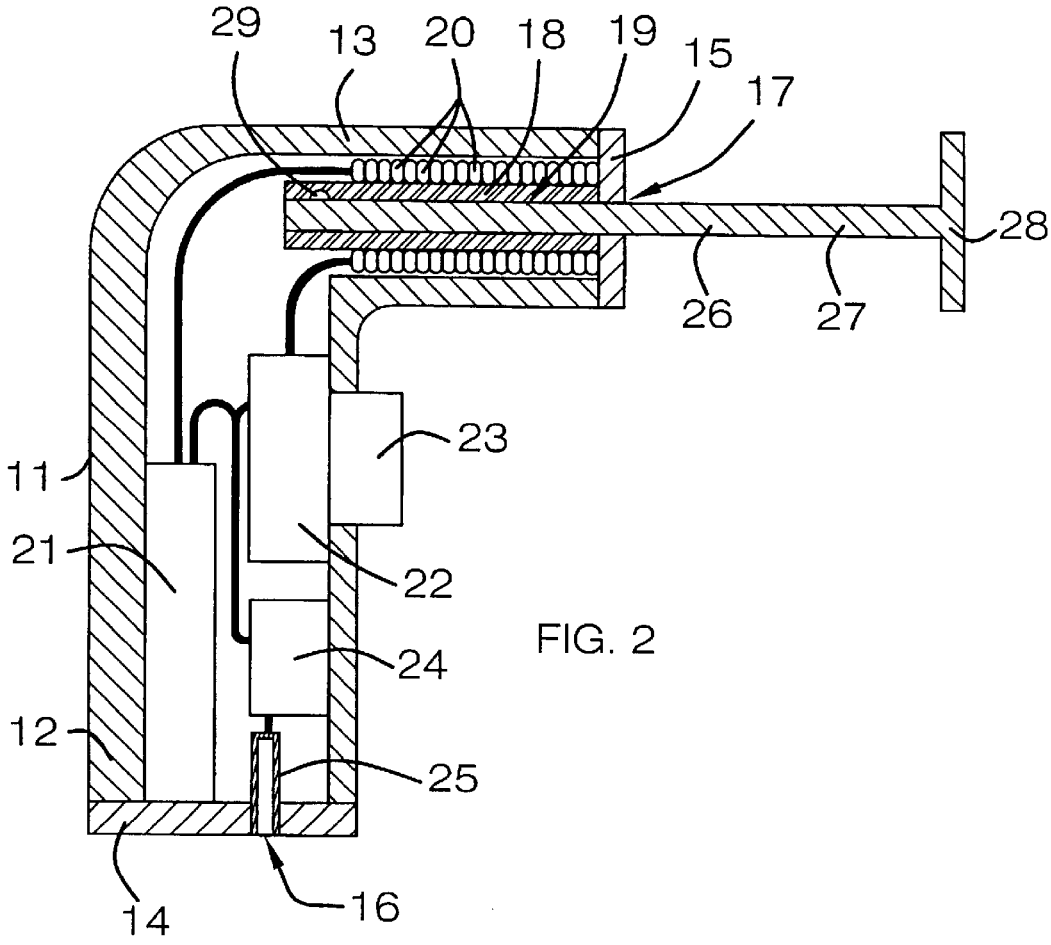
FIG. 2 is a cross-sectional view of the present invention.

With reference now to the drawings, and in particular to FIGS. 1 through 3 thereof, a new magnet assembly embodying the principles and concepts of the present invention and generally designated by the reference numeral 10 will be described.

As best illustrated in FIGS. 1 through 3, the magnet assembly 10 generally comprises an elongate housing 11 having side and end walls 14,15, and also having openings 16,17 in the end walls 14,15. The elongate housing 11 further has an elongate handle position 12 and an elongate head portion 13. The ends walls 14,15 include a first end wall 14 being disposed at an end of the elongate handle portion 12 and also include a second end wall 15 being disposed at an end of the elongate head portion 13. The elongate housing 11 also has an elongate tubular member 18 being conventionally disposed therein and being conventionally attached to the second end wall 15 and also having a bore 19 being disposed therethrough and being aligned with the opening 17 through the second end wall 15. The elongate head portion 13 is angled approximately 90 degrees relative to the elongate handle portion 12.

A means of producing magnetism includes coiled wires 20 being conventionally disposed in the elongate housing 11, and also includes a battery 12 being conventionally disposed in the elongate housing 11 and being conventionally connected to the coiled wires 20, and further includes an on/off switch 22, 23 being movably and conventionally mounted to the elongate housing 11 and being conventionally connected to the battery 12 and to the coiled wires 20. The coiled wires 20 are wound about the elongate tubular member 18 for the magnetizing thereof. The means of producing magnetism further includes a jack 24 being conventionally disposed in the elongate housing 11 and being conventionally attached to the first end wall 14 and being disposed over the opening 16 through the first end wall 14, and also includes a power cord 36 having a plug 37 being conventionally attached at a first end thereof and being removably received in the jack 24, and further includes an electrical adapter 38 being conventionally attached at a second end of the power cord 36 and having a housing member 39 with prongs 40 extending therefrom. The means of producing magnetism also includes a circuitry mechanism 24 for recharging the battery. The circuitry mechanism 24 is conventionally disposed in the elongate handle portion 12 of the elongate housing 11 and being conventionally connected to the jack 25 and to the battery 21 and to the on/off switch 22,23. The on/off switch 22,23 includes a switch box 22 being conventionally disposed in the elongate handle portion 12 of the elongate housing 11, and also includes a switch button 23 being movably an conventionally disposed through the side wall of the elongate housing 11.

At least one magnetizable tool 26,30 is removably received through one of the openings 17 of the elongate housing 11 for picking up small objects. The at least one magnetizable tool 26,30 includes a first tool 26 having a shaft portion 27 being removably received through the opening 17 of the second end wall 15 and in the bore 19 of the elongate tubular member 18, and also includes a disc-shaped head portion 28, and further includes a ball-shaped detent 29 being conventionally attached to the shaft portion 27. The at least one magnetizable tool also includes a second tool 30 having a shaft 31 being removably received through the opening 17 of the second end wall 15 and in the bore 19 of the elongate tubular member 18, and also includes a plurality of times 33 being integrally extended outwardly from the shaft 31, and further includes a ball-shaped detent 32 being conventionally attached to the shaft 31. Each of the times 33 includes a first end portion 34 which is conventionally attached to and extends outwardly generally perpendicular to the shaft 31, and also includes a second end portion 35 which is angled relative to the first end portion 34 and which is disposed generally parallel to the shaft 31.

In use, the user attaches either the first or second tool 26,30 in bore 19 of the elongate tubular member 18, and energizes the coiled wires 20 which magnetize the magnetizable tool 26,30 using the on/off switch 22,23. The user then places the magnetizable tool 26,30 upon the objects which are picked up by the magnetized tool 26,30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the magnet assembly. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. An electromagnetic pick up tool comprising:

an elongate housing having side and end walls, and also having openings in said end walls, said elongate housing further having an elongate handle portion and an elongate head portion, said ends walls including a first end wall being disposed at an end of said elongate handle portion and also including a second end wall being disposed at an end of said elongate head portion, said elongate housing also having an elongate tubular member being disposed therein and being attached to said second end wall and also having a bore being disposed therethrough and being aligned with said opening through said second end wall, said elongate head portion being angled approximately 90 degrees relative to said elongate handle portion;

a means of producing magnetism including coiled wires being disposed in said elongate housing, and also including a battery being disposed in said elongate housing and being connected to said coiled wires, and further including an on/off switch being movably mounted to said elongate housing and being connected to said battery and to said coiled wires; and at least one magnetizable tool being removably received through one of said openings of said elongate housing for picking up small objects.

2. An electromagnetic pick up tool comprising:

an elongate housing having side and end walls, and also having openings in said end walls, said elongate housing further having an elongate handle portion and an elongate head portion, said ends walls including a first end wall being disposed at an end of said elongate handle portion and also including a second end wall being disposed at an end of said elongate head portion, said elongate housing also having an elongate tubular member being disposed therein and being attached to said second end wall and also having a bore being disposed therethrough and being aligned with said opening through said second end wall;

a means of producing magnetism including coiled wires being disposed in said elongate housing, and also including a battery being disposed in said elongate housing and being connected to said coiled wires, and further including an on/off switch being movably mounted to said elongate housing and being connected to said battery and to said coiled wires, said coiled wires being wound about said elongate tubular member for the magnetizing thereof, said means of producing magnetism further including a jack being disposed in said elongate housing and being attached to said first end wall and being disposed over said opening through said first end wall, and also including a power cord having a plug being attached at a first end thereof and being removably received in said jack, and further including an electrical adapter being attached at a second end of said power cord and having a housing member with prongs extending therefrom, said means of producing magnetism being disposed in said elongate handle portion of said housing and being connected to said jack and to said battery and to said on/off switch, said on/off switch including a switch box being disposed in said elongate handle portion of said elongate housing, and also including a switch button being movably disposed through said side wall of said elongate housing; and at least one magnetizable tool being removably received through one of said openings of said elongate housing for picking up small objects, said at least one magnetizable tool including a first tool having a shaft portion being removably received through said opening of said second end wall and in said bore of said elongate tubular member, and also including a disc-shaped head portion, and further including a ball-shaped detent being attached to said shaft portion.

3. An electromagnetic pick up tool comprising:

an elongate housing having side and end walls, and also having openings in said end walls, said elongate housing further having an elongate handle portion and an elongate head portion, said ends walls including a first end wall being disposed at an end of said elongate handle portion and also including a second end wall being disposed at an end of said elongate head portion, said elongate housing also having an elongate tubular member being disposed therein and being attached to said second end wall and also having a bore being disposed therethrough and being aligned with said opening through said second end wall;

a means of producing magnetism including coiled wires being disposed in said elongate housing, and also including a battery being disposed in said elongate housing and being connected to said coiled wires, and further including an on/off switch being movably mounted to said elongate housing and being connected to said battery and to said coiled wires, said coiled wires being wound about said elongate tubular member for the magnetizing thereof, said means of producing magnetism further including a jack being disposed in said elongate housing and being attached to said first end wall and being disposed over said opening through said first end wall, and also including a power cord having a plug being attached at a first end thereof and being removably received in said jack, and further including an electrical adapter being attached at a second end of said power cord and having a housing member with prongs extending therefrom, said means of producing magnetism being disposed in said elongate handle portion of said housing and being connected to said jack and to said battery and to said on/off switch, said on/off switch including a switch box being disposed in said elongate handle portion of said elongate housing, and also including a switch button being movably disposed through said side wall of said elongate housing; and at least one magnetizable tool being removably received through one of said openings of said elongate housing for picking up small objects, said at least one magnetizable tool including a shaft being removably received through said opening of said second end wall and in said bore of said elongate tubular member, and also including a plurality of tines being extended outwardly from said shaft, and further including a ball-shaped detent being attached to said shaft.

4. An electromagnetic pick up tool A magnet assembly as described in claim 3, wherein each of said tines includes a first end portion which is attached to and extends outwardly generally perpendicular to said shaft, and also includes a second end portion which is angled relative to said first end portion and which is disposed generally parallel to said shaft.

* * * * *